US008083658B2

(12) United States Patent
Veluz et al.

(10) Patent No.: US 8,083,658 B2
(45) Date of Patent: Dec. 27, 2011

(54) TOBACCO SMOKE FILTER PRODUCTION

(75) Inventors: Serge Veluz, Cuarnens (CH); Alexis Louvet, Lausanne (CH)

(73) Assignee: Filtrona International Limited, Milton Keynes, Buckingham (GB)

( * ) Notice: Subject to any disclaimer, the term of this patent is extended or adjusted under 35 U.S.C. 154(b) by 1065 days.

(21) Appl. No.: 11/792,212

(22) PCT Filed: Dec. 5, 2005

(86) PCT No.: PCT/GB2005/004644

§ 371 (c)(1), (2), (4) Date: Nov. 16, 2007

(87) PCT Pub. No.: WO2006/059134

PCT Pub. Date: Jun. 8, 2006

(65) Prior Publication Data

US 2008/0190439 A1 Aug. 14, 2008

(30) Foreign Application Priority Data

Dec. 3, 2004 (GB) ..... 0426615.1

(51) Int. Cl.
*B31C 99/00* (2009.01)

(52) U.S. Cl. ..... 493/39; 493/42; 493/44

(58) Field of Classification Search ..... 493/39, 493/42, 44, 46, 47, 48, 50

See application file for complete search history.

(56) References Cited

U.S. PATENT DOCUMENTS

| | | | | | |
|---|---|---|---|---|---|
| 3,312,151 | A | * | 4/1967 | Molins | 493/47 |
| 3,312,152 | A | * | 4/1967 | Williamson | 493/47 |
| 3,570,557 | A | * | 3/1971 | Molins | 141/99 |
| 3,613,635 | A | * | 10/1971 | Brehm | 118/406 |
| 3,844,200 | A | * | 10/1974 | Sexstone | 493/45 |
| 4,016,830 | A | | 4/1977 | Sexstone et al. | |
| 4,064,791 | A | * | 12/1977 | Berger | 493/43 |
| 4,184,412 | A | | 1/1980 | Hall | |
| 4,223,597 | A | * | 9/1980 | Lebet | 493/45 |
| 4,355,995 | A | * | 10/1982 | Berger | 493/43 |
| 4,791,943 | A | * | 12/1988 | Kupper et al. | 131/339 |
| 5,012,829 | A | * | 5/1991 | Thesing et al. | 131/344 |
| 5,234,397 | A | | 8/1993 | Wahle et al. | |
| 6,537,186 | B1 | * | 3/2003 | Veluz | 493/42 |

FOREIGN PATENT DOCUMENTS

| | | |
|---|---|---|
| DE | 100 10 176 A1 | 9/2001 |
| EP | 1106087 A2 | 6/2001 |
| GB | 1585761 A | 3/1981 |
| GB | 2058542 A | 4/1981 |
| WO | WO 00/51451 A | 9/2000 |

OTHER PUBLICATIONS

International Search Report and Written Opinion dated Mar. 1, 2006.

* cited by examiner

*Primary Examiner* — Sameh H. Tawfik

(74) *Attorney, Agent, or Firm* — Flynn, Thiel, Boutell & Tanis, P.C.

(57) ABSTRACT

A method and apparatus for tobacco smoke filter production wherein a train of tobacco smoke filtering material, while being continuously advanced longitudinally, is gathered towards rod shape and then shaped to and secured in rod form, and wherein there is discontinuous pneumatic injection of particulate additive through an injector conduit laterally into the advancing gathering material to form separate additive pockets embedded in and spaced along the continuously produced rod.

15 Claims, 5 Drawing Sheets

TOBACCO SMOKE FILTER PRODUCTION

FIELD OF THE INVENTION

This invention concerns tobacco smoke filters and provides a method of tobacco smoke filter production.

BACKGROUND AND SUMMARY OF THE INVENTION

According to the method of tobacco smoke filter production of the invention, a train of tobacco smoke filtering material is continuously advanced longitudinally, the advancing filtering material is gathered towards rod shape, the gathered advancing filtering material is shaped to and secured in rod form, and the resulting continuously produced rod of filtering material may be cut into finite lengths, and wherein there is discontinuous pneumatic injection of particulate additive (e.g. through an injector barrel or conduit, which is preferably stationary) laterally into the advancing gathering filter material to form separate additive pockets embedded in and longitudinally spaced along the continuously produced rod. In some embodiments separate pockets of particulate additive are sequentially pneumatically injected (e.g. through a fixed injector conduit) laterally into the advancing gathering filtering material to become embedded in and longitudinally spaced along the continuously produced rod.

Apparatus according to the invention for the manufacture of tobacco smoke filters comprises means for continuously advancing a train of tobacco smoke filtering material longitudinally, a device for gathering the advancing filtering material, a plugmaker for shaping and securing the advancing gathered filtering material in rod form, optional cutting means for transversely cutting the continuously produced rod into finite lengths, a pneumatic injector conduit (usually fixed) connectable to means for supplying particulate additive thereto, and pneumatic injection means for discontinuously admitting particulate additive into the injector conduit and moving it therealong, the injector conduit extending laterally of and into the path of the filtering material for discharge transversely of and within the gathering device. In some embodiments the pneumatic injection means conveys separate pockets of particulate additive from said supplying means sequentially along the injector conduit (which is usually stationary).

Gas used for pneumatic particle injection may be vented from the gathering filtering material. Additionally or instead some, most or all of the gas used for pneumatic particle injection may be vented or withdrawn from upstream of the point of particle injection. In all cases the impetus or momentum or kinetic energy pneumatically imparted to the particles intended for pocket formation (as distinct from unwanted fines and/or other dust) is sufficient to ensure their travel to and injection into the gathering filtering material. It is thus to be understood that all references herein to "pneumatic conveyance", "pneumatic injection", "pneumatic conveyance and injection" and the like apply, where the context allows, not only to cases where some or all of said gas passes into the gathering filtering material along with the particles, but also to those where little or none does because most or all has vented or been extracted upstream. Reducing or avoiding the release of pneumatic injection gas into the gathering filtering material can reduce or prevent the scattering or dispersal of injected particles within said material and so improve the sharpness of pocket definition and separation in the product rod.

Passage and injection of the particulate additive transversely of (rather than axially along), and especially radially of, the filtering material path permits reduction or minimising of the time and distance of pneumatic conveyance of the additive into the filtering material, and hence can ensure that the resulting additive pockets are separate and can optimise the accuracy, reliability and controllability of the embedded additive pockets. Injection transverse to, especially radially of, the machine direction can minimise dispersal of injected additive particles longitudinally of the rod and so reduce or eliminate the occurrence of unwanted stray injected particles between pockets or at (or too near to) the ends of cut filter lengths.

The pneumatic conveyance of the particulate additive to the point of injection is preferably as short as practically possible, and hence is suitably rectilinear or substantially so; for example, said path may be as little as 170 mm. long, more advantageously 150 mm. or less, for filters of conventional size and content as indicated hereinafter. In particularly preferred embodiments said path may be about 135 mm. long or even less; the use of an injector conduit to extend from an external particle supply into the gathering device does of course impose a practical minimum length. Lateral pneumatic conveyance and injection of the particulate additive may be substantially radially of (i.e. at right angles to) the axis of the advancing gathering filtering material; in this case the pneumatic conveyance path of the particulate additive will be through the wall of the device used to effect the gathering. Lateral pneumatic conveyance and injection of the particulate additive could instead be non-perpendicular to the axis of the filtering material path; when such conveyance and injection are in the same general direction as the advance of the filtering material, the pneumatic conveyance path of the particles could then be obliquely through the open upstream mouth of the gathering device rather than through its wall.

For sale and subsequent use, the initial continuously produced rod will usually have to be cut into lengths, preferably as part of the continuous process or apparatus operation. To ensure the required spacing between cuts along the continuously produced rod, and their required general positioning (e.g. between rather than through embedded pockets of particulate additive so that the cut filter rods have clean end appearance), it is preferred for a cutter to be geared to the throughput of the filtering material (e.g. to the machine drive) and for operation of the injection to be synchronised with the cutter—the injector preferably being the slave of the cutter. Within such synchronisation, however, the pneumatic conveyance and injection operations may be adjustable to achieve a more specific required positioning of the embedded pockets along the cut rods—e.g. towards the centres or the ends of the cut rods.

In filters according to the invention the embedded additive pockets can be fully enclosed in the matrix of filtering material, and are compact but may taper towards one or both ends—e.g. may be of a generally ellipsoidal configuration. In the initially produced rod the embedded pockets of additive may have even longitudinal spacing. It may be preferred, however, to have other pocket dispositions—e.g. relatively close longitudinal spacing alternating with longer spacing—it being possible to achieve this by appropriate adjustment of the timing and pattern of the injections; this can facilitate the provision of eventual single filters with a single embedded additive pocket close to one end (preferably the tobacco end in a filter cigarette) and remote from the other end (preferably the buccal end), as explained below with reference to FIG. 4 of the accompanying drawings. The individual filters according to the invention will usually each have a single embedded particulate additive pocket, but there could instead be a plurality of smaller longitudinally spaced such pockets in an individual filter. A filter according to the invention may be attached end-to-end to a wrapped tobacco rod (e.g. by ring tipping or a full tipping overwrap) in a filter cigarette according to the invention.

Any filter or filter cigarette according to the invention may be ventilated. Thus if the filter has its own plugwrap the latter may be of inherently air-permeable material and/or provided with ventilation holes or larger apertures, and may be exposed when used with ring tipping in a filter cigarette. A ventilating full tipping overwrap may likewise be inherently air-permeable or provided with ventilation holes, and in ventilated products where both filter plugwrap and tipping overwrap are present ventilation through the overwrap will usually be in register with that through the plugwrap. Ventilation holes through a filter plugwrap, or through a tipping overwrap, or through both simultaneously, may be made by laser perforation during filter or filter cigarette production. Where ventilation in a filter or filter cigarette according to the invention is localised longitudinally of the product, this localisation is preferably to one or two regions selected from upstream of, downstream of, and in register with the or a particulate additive pocket, depending upon the ventilation and filtering performances required; ventilation upstream of and/or in register with a particulate additive pocket is frequently preferred. There could be ventilation between pockets when two or more are present. There may be ventilation only into the tobacco rod, only into the filter, or into both. The degree of ventilation may be 50% or less (e.g. 40 or 30% or lower) but is preferably over 50% (e.g. 60% or 70% or higher)—as measured in the fashion standard in the art.

The invention permits the efficient manufacture in a single-pass continuous operation of commercially acceptable composite filters having distinct particulate and filtering matrix portions.

The additive particles employed in the invention may be of any of smoker-acceptable material, but will normally be from those conventionally used in tobacco smoke filter production, including sorbents (e.g. selected from activated carbon, silica gel, sepiolite, alumina, ion exchange material etc), pH modifiers (e.g. alkaline material such as sodium carbonate, acidic materials), and flavourants. They will usually be sorbent particles, preferably carbon particles—especially activated carbon granules. Mixtures of different particulates can be employed. Flavourant, e.g. menthol, may be carried by substrate (e.g. sorbent) particles.

The filtering material forming the rod matrix within which the additive pockets are embedded may likewise be selected from any of those materials (usually filamentary, fibrous, web or extruded) conventionally employed for tobacco smoke filter manufacture. Natural or synthetic filamentary tow, e.g. of cotton or plastics such as polyethylene or polypropylene, but especially cellulose acetate filamentary tow, is the preferred filter matrix material, but other conventional materials, e.g. natural or synthetic staple fibres, cotton wool, web material such as paper (usually creped) and synthetic non-wovens, and extruded material (e.g. starch, synthetic foams) can be used additionally or instead. The shaping and securing of the filter material in rod form may involve applying a conventional plugwrap (which may be air-permeable or—impermeable) secured by a lapped and stuck seam in the usual way; where the filtering material incorporates a heat-activatable adhesive, application of heat during rod formation can bind the filtering material together to provide a rod which is coherent and dimensionally stable without a plugwrap—though a plugwrap may still be provided if preferred.

The particulate additive is usually held in a reservoir under pneumatic pressure, which feeds it into an injector conduit or barrel. It is convenient for such injector conduit or barrel to extend through the reservoir; this provides a compact and efficient system and can minimise the pneumatic travel distance and time of additive through the injector into the gathering filtering material.

In some preferred embodiments the additive particles pass continuously into a pneumatic injector conduit to which sequential pulses of conveyor gas are supplied for said discontinuous injection; thus sequential pulses of pressurised conveyor gas may carry respective sequential spaced pockets of the particulate additive laterally into the gathering filtering material. The size and spacing of the embedded additive pockets in the rod product depend, for a given rate of filtering material throughput, on the frequency of the pulses and the rate of feed of the additive particles (e.g. from a reservoir as above) to the conduit.

In other embodiments the additive particles are fed discontinuously into a pneumatic injector conduit via a valve which repeatedly moves or changes between open and closed positions, and the particulate additive entering the conduit whilst the valve is open is moved along the conduit by a stream of conveyor gas for said discontinuous lateral injections. Thus the particles may be fed from a reservoir or other supply means into an injector conduit through a said valve, a high velocity (and/or high volume flow rate) stream of carrier gas being passed continuously through the injector conduit so that when a pocket of particulate additive enters whilst the valve is momentarily open it is separately conveyed along the injector conduit and injected laterally into the gathering filtering material. However, although the valve opens only momentarily, a stream of particles may in fact pass continuously therethrough over a finite period whilst it is open (e.g. increasing and then decreasing if it opens and closes progressively), and the speed of pneumatic conveyance and injection may be so high that each particle as it enters the conduit is transferred virtually instantaneously into the gathering filter material where pocket formation occurs. In all cases, the speed of pneumatic conveyance and injection, relative to the slower longitudinal advance of the filtering material, permits the formation of a product rod with compact and well-defined additive pockets spaced along its length. Operation of the valve is preferably controlled by a cutter to avoid cutting through pockets, but precise positioning of pockets lengthwise of the cut rods may be achieved by adjustment of the synchronised valve operation regime. For given conveyance and injection speed the size of the embedded pockets depends on the rate of feed of additive particles into the conduit (which may in turn depend largely on the size of the open valve inlet) and the timing and speed of operation of the valve (which may for example be operated electrically or pneumatically); and pocket spacing depends on the timing of valve operation.

As indicated generally above, pneumatic conveyor gas may be vented from the filtering material before the latter is condensed to rod form—e.g. with the help of escape holes through the wall of the gathering device. Such gas may additionally or instead be vented laterally from an injection conduit or barrel upstream of its particle outlet (and preferably from outside of the filtering material or outside of a gathering device), with or without the positive assistance of applied suction; especially when such lateral venting is by vacuum outflow, the rate of gas extraction can be sufficiently high to let little or none of the conveyor gas reach and exit from the particle outlet, and hence to obviate the need for venting from the gathering filtering material; a high volumetric rate of such vacuum outflow (e.g. higher than the volumetric inflow rate)

upstream of particle injection can reduce or prevent the injection of unwanted dust and additive fines into the gathering filtering material—whilst the larger additive particles for pocket formation, readily accelerated by the conveyor gas stream to high speeds (e.g. 100 to 200 m/sec. or higher), continue to and through the particle injection outlet without undue velocity reduction.

In all circumstances pneumatic particle conveyance and injection radially of the filtering material path has the advantages indicated above. However, the above-described feature of substantially instantaneous pneumatic transport of successive particles into the filtering material, with pocket formation occurring only in the filtering material and being complete only after injection, can also usefully be employed for discontinuous particle injection with pneumatic particle conveyance and/or injection non-perpendicular to (including axially of) the filtering material path. Likewise the venting or extraction of pneumatic conveyor gas from upstream of particle injection can also usefully be employed for discontinuous particle injection with pneumatic particle conveyance and/or injection non-perpendicular to (including axially of) the filtering material path; vacuum withdrawal of such gas upstream of such particle injection, especially at high volumetric outflow rate, can be particularly appropriate for good product quality in these circumstances. Accordingly in another aspect of the invention there are provided a process and machine for making a tobacco smoke filter rod having separate pockets of particulate additive embedded therein and longitudinally spaced therealong, in which a train of tobacco smoke filter material is continuously advanced longitudinally, the advancing material is gathered towards rod shape, particulate additive is pneumatically injected into the advancing gathering material by use of a stream of conveyor gas, and the advancing gathering material with injected additive is shaped to and held in rod form, and wherein the particulate additive is fed discontinuously into the conveyor gas stream by means, e.g. a valve which moves or changes repeatedly between open and closed positions, which repeatedly and intermittently feeds the additive continuously, and for each feed period the individual particles for injection, immediately on entering the conveyor gas stream, are transferred substantially instantaneously thereby into the gathering advancing filter material where they accumulate to form a corresponding said separate embedded pocket; and a further aspect of the invention provides a process and apparatus in which a longitudinally advancing train of tobacco smoke filter material is gathered towards rod shape and then shaped and secured in rod form, particulate additive is pneumatically injected discontinuously into the gathering material to form separate additive pockets embedded in and spaced along the product rod, and pneumatic injection gas is vented or extracted from upstream of the point of particle injection, usually outside of the gathering filtering material and preferably outside of a device used to effect the gathering. In each of these aspects of the invention, any or all of the other method and apparatus features as disclosed above and hereinafter (e.g. related to additive conveyance and/or injection transversely of the machine direction, use of an injector conduit which may be fixed or stationary, conveyor/injection gas venting and/or extraction details, numerical values, suitable additive and filter materials, etc.) can be used unless precluded by the broad aspect definition.

BRIEF DESCRIPTION OF THE DRAWINGS

The invention is illustrated, by way of example only, by the following description in conjunction with the accompanying drawings, in which like numerals denote like items and in which.

DETAILED DESCRIPTION

Figure 1:
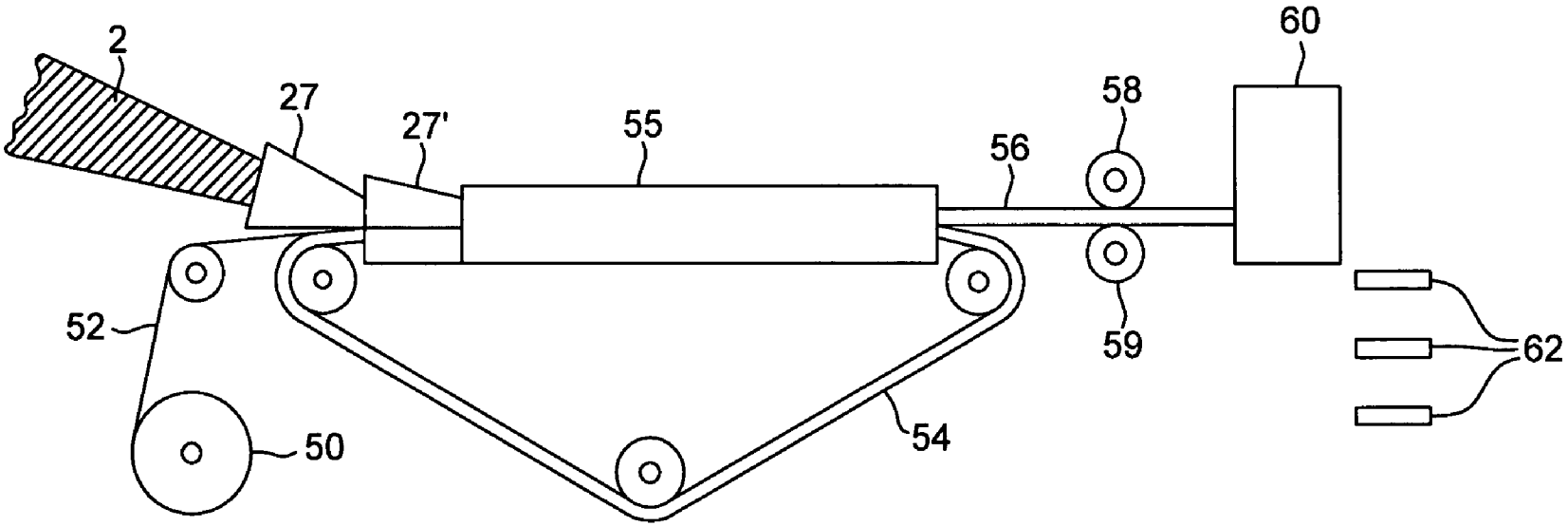
FIG. 1 (PRIOR ART)
FIG. 1 is a schematic illustration of the relevant parts of a conventional cigarette filter rod making machine.

In the conventional system shown in FIG. 1, a spread tow 2 of plasticised cellulose acetate filaments, which has been subjected to the usual pre-treatment stages (not shown), is gathered towards rod shape by funnels 27, 28 as it advances to plugmaker 55, which forms it continuously into elongate filter rod 57. Plugwrap 52 from a supply roll 50, and the tow 2, are conveyed through the plugmaker 55 on and by a conveyor 54 which also wraps plugwrap 52 around the rod as the rod is formed and secures it in place by means of a lapped and stuck seam. Rod 57 passes from conveyor 54 via rolls 58, 59 to a cutting device 60 which severs the formed rod into finite lengths 61.

Figure 2:
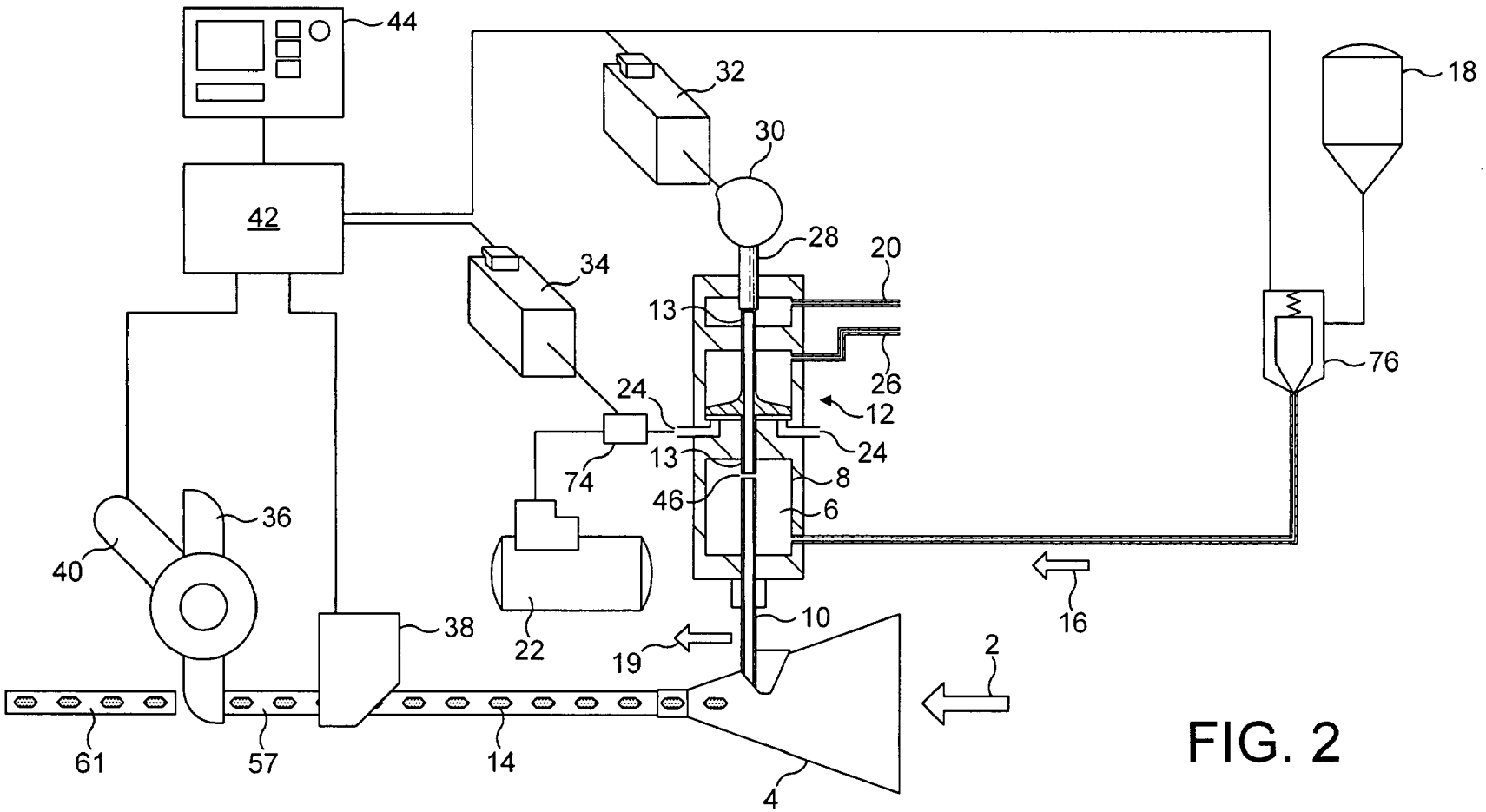
FIG. 2 schematically illustrates the radial injection of particulate additive in cigarette filter rod manufacture according to the present invention.

The gathering or condensing means 27, 28 of FIG. 1 could be replaced by a single gathering funnel or the like. Such a single gathering funnel 4 is shown in FIG. 2, where 2 is the tow supply as in FIG. 1 but the plugmaker etc. of FIG. 1 is omitted for clarity. In FIG. 2 carbon granules 6 from a supply reservoir 8 are discontinuously injected radially into the gathering tow in funnel 4 through injector barrel 10 by means of an injection mechanism 12 shown in more detail in FIG. 3. The carbon granules are conveyed pneumatically along injector barrel 10 and exit the barrel to form pockets 14 embedded in and spaced along the continuously produced filter rod 57; whilst pockets 14 are shown in FIG. 2, they would of course not be visible in the rod in practice. The carbon supply 16 to reservoir 8 is maintained under pneumatic feeding pressure from main tank 18. Air pulse generator 74, controlled by electric motor 34, receives high pressure air from compressor 22 and directs rapidly repeating high pressure air pulses into injection mechanism 12 at 24 to correspondingly repeatedly re-open a valve of mechanism 12, the valve being closed between said pressure pulses by constant push-back air pressure from 26. In operation, the valve thus oscillates to repeatedly shut and re-open very rapidly. As the valve opens momentarily at 46 and until it closes shortly thereafter, carbon granules enter barrel 10 from reservoir 8; entering particles are immediately separately carried rapidly along barrel 10 and injected radially into the gathering tow by a high velocity flow (e.g. 100 to 200 or more meters/second) of driving or conveying air which is passed continuously into barrel 10 from 20, and virtually instantaneous conveyance and injection of entering granules continues until the valve closes to momentarily stop the granule feed; carbon granules are thus discontinuously injected radially into the passing tow to form spaced additive pockets 14 in the product filter rod; the tow throughput and the speed and timing of pneumatic injection are such that the tow advances only a short distance during each injection, facilitating formation of a product rod with well-defined spaced granule pockets. The stroke, or opening travel, of the valve of injection mechanism 12 is limited by a stop 28 whose position is determined by cam 30 adjustable by an electric motor 32 controlled by flow rate controller 76. A cutting device 36 severs the continually produced rod 57 to finite lengths such as those shown at 61, these usually being an even multiple of (e.g. 2 or 4 or 6 times) the length of the eventual individual filters. The cutting device 36, by way of infrared registration cell 38, encoder 40 and controller 42 with user interface 44, is synchronised with the tow feed and controls synchronised operation of the injection mechanism to ensure cutting only between the embedded pockets and not through a pocket.

If conveying air from 20 enters funnel 4 it may be vented from the filtering material before the latter is fully shaped to rod form, e.g. via apertures (not shown) through the wall of funnel 4. Additionally or instead there may be venting or extraction of conveyor gas laterally out of barrel 10 between valve opening 46 and the granule injection outlet. Thus arrow 19 indicates such optional gas venting or extraction outside of the gathering filtering material and funnel 4; this could be by way of an outlet port or ports (not shown) through the wall of conduit 10, or through piping (not shown) connecting the interior of conduit 10 to a vacuum source; in the latter case the volumetric vacuum outflow rate may be high enough (e.g. greater than the volumetric inflow rate from 20) to remove unwanted dust and carbon fines but without unduly affecting injection of the larger granules for pocket formation.

Figure 3A:
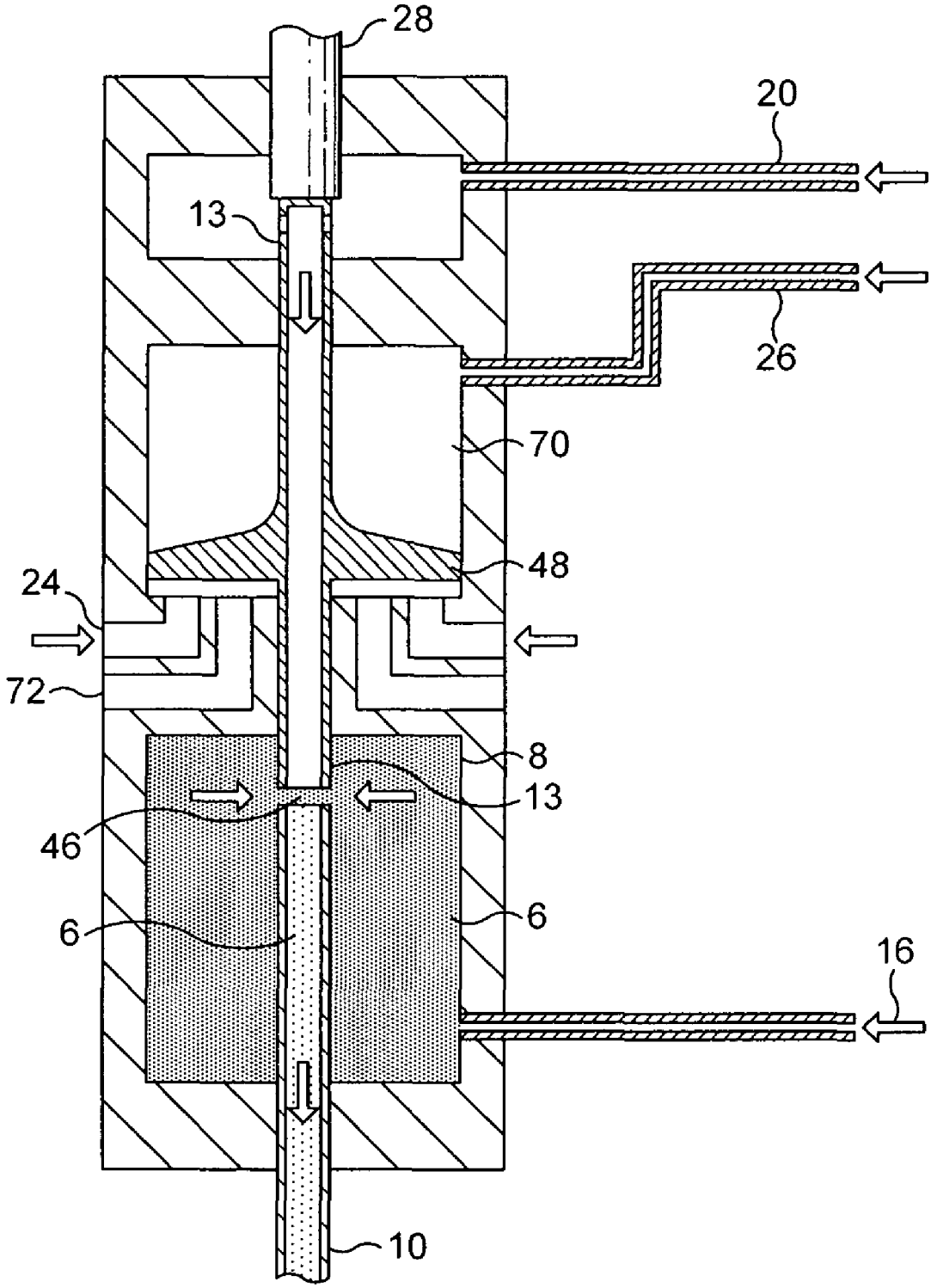
FIGS. 3(*a*) and 3(*b*) schematically show more detail of an embodiment of injection means for use according to the invention as in FIG. 2.
Figure 3B:
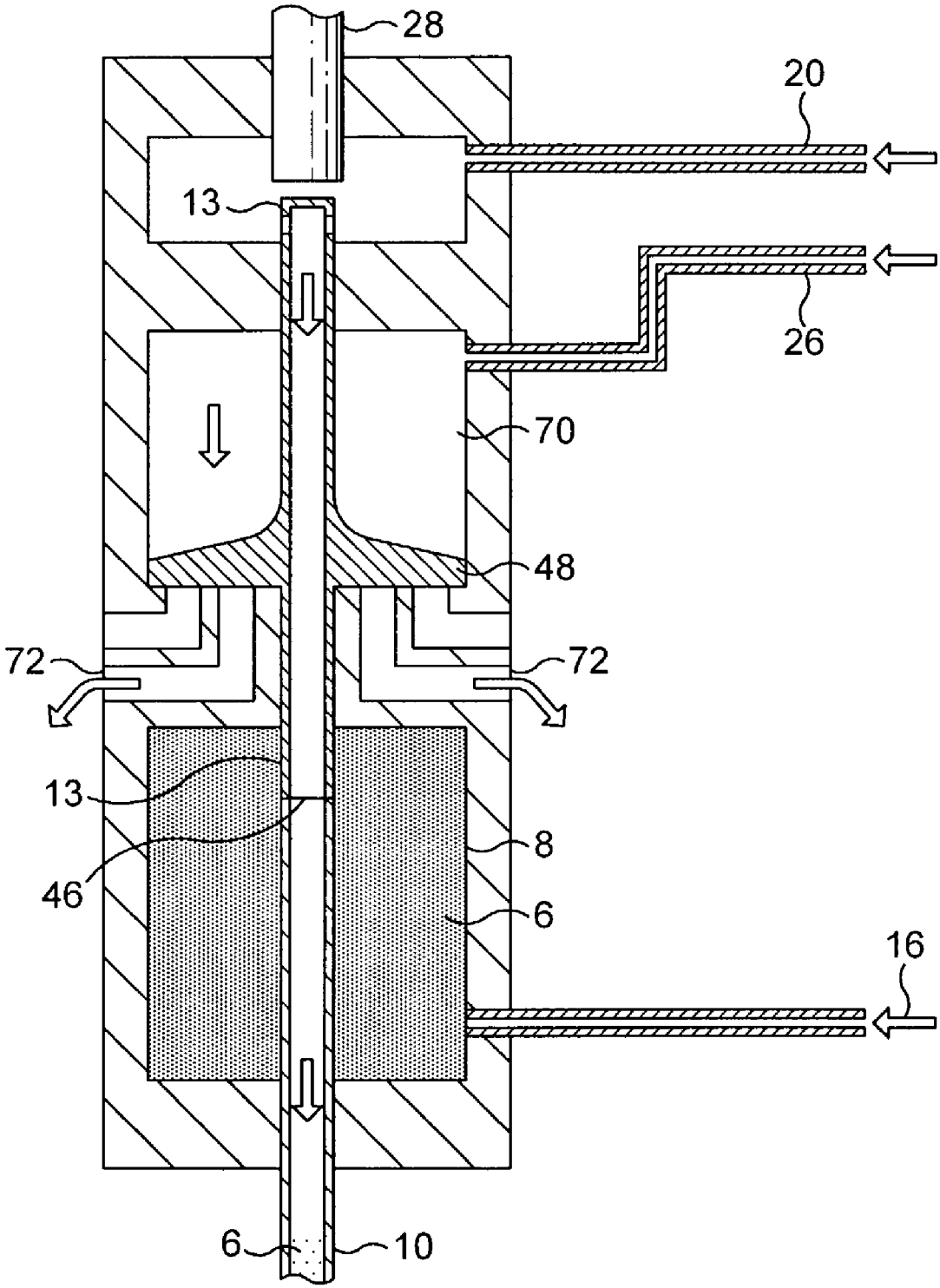

The injection device 12 of FIG. 2 is shown more clearly in FIGS. 3 (*a*) and 3(*b*) in which its valve 13, 48 is shown respectively open and closed at 46. FIG. 3 (*a*) shows carbon granules entering injector barrel 10 through the opening at 46 (see also FIG. 2) of valve 13, 48 within the reservoir 8. A high pressure air pulse at 24 is shown acting on piston 48 of valve 13 to push it back into the air-spring chamber 70 against the push-back pressure from 26, momentarily opening the valve at 46, to the extent permitted by stop 28, to allow the entry of carbon granules into injector barrel 10. FIG. 3(*a*) indicates granules 6 dispersed into a relatively diffuse stream by their rapid pneumatic conveyance away from the valve inlet 46. On cessation of the high pressure air pulse at 24, then as shown in FIG. 3 (*b*), the push-back pressure from 26 recloses the valve with exhaust air venting at 72 and with the carbon granules having been carried away and injected radially into the gathering tow through barrel 10 by the constant supply of driving air from 20. FIG. 3(*b*) indicates the final few granules 6 which entered conduit 10 immediately before full closure of the valve at 46. It is emphasised that the representation of granules 6 in conduit 10 of FIGS. 3(*a*) and (*b*) is purely schematic. The position of adjustable stop 28 determines the maximum size of inlet 46 of the valve; for given operating conditions (reservoir pressure, valve movement speed, and time for which the valve is fully open) product pocket size is thus simply adjusted by adjustment of stop 28.

In the embodiment and modifications thereof described above with reference to the drawings, the injector barrel 10 extends radially of the axis of the filtering material path, but it could instead be non-perpendicular to the axis—e.g. extending obliquely through the open upstream mouth of the gathering device to within the gathering tow.

Figure 4:
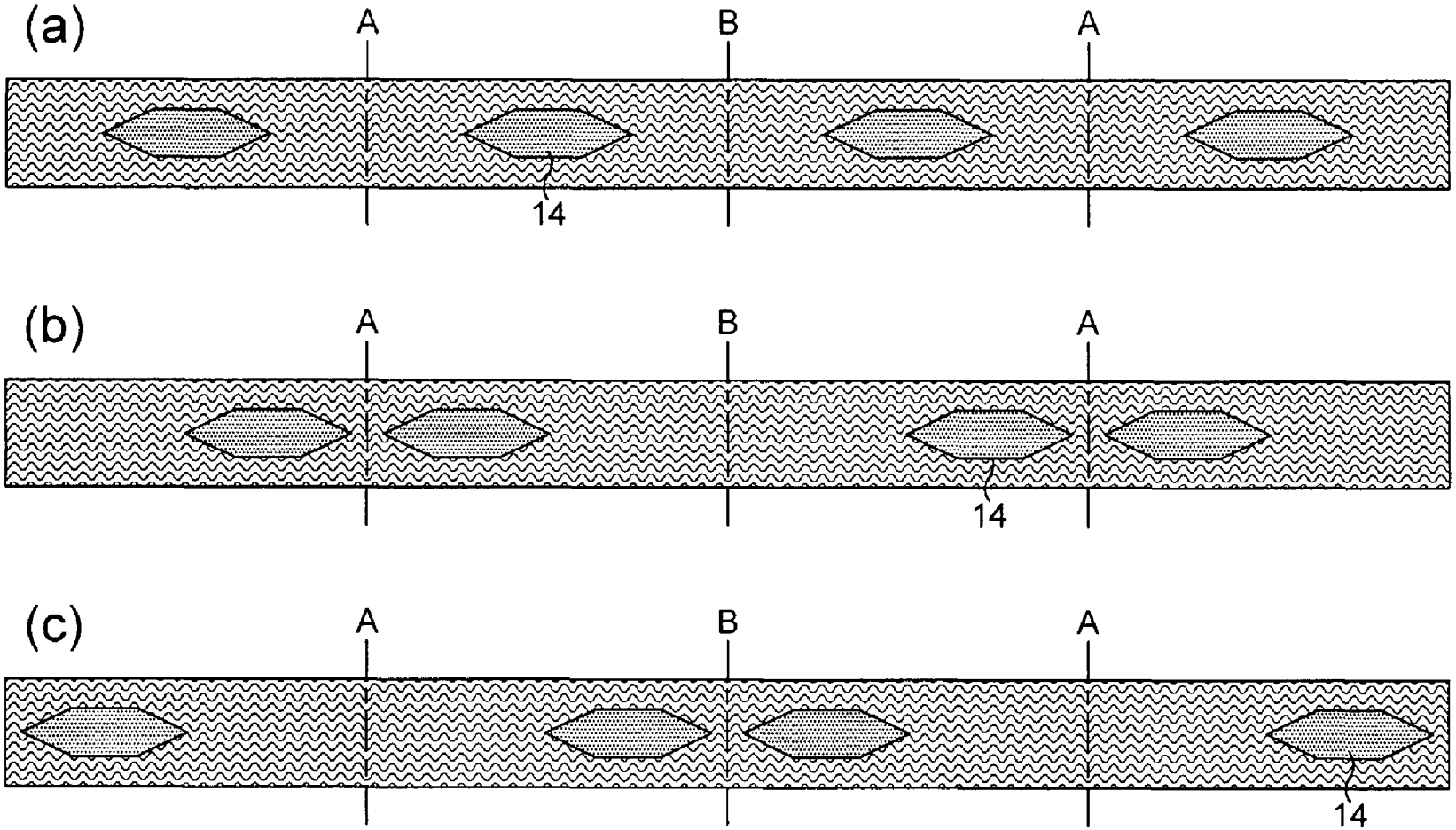
FIG. 4 schematically illustrates options for disposition of the particulate additive pockets in multiple length filter rods made according to the invention.

Different patterns of embedded additive pockets in the product rod can be obtained by adjustment of the pattern of air pulses at 24 and hence of the pattern of opening and closing of the valve of the injection mechanism. FIG. 4 illustrates three possibilities for additive pocket location in filter rods according to the present invention. The illustrated quadruple length rods supplied for filter cigarette manufacture would normally be severed first along line B to give two double length rods; each double length rod would then have two tobacco rods attached thereto, one at each end, followed by cutting along line A to yield two filter cigarettes. In option (a) the fully enclosed pockets 14 are equally and uniformly spaced along the rod, and in the eventual individual filter on a filter cigarette the pocket 14 would be centrally located. In option (b), the valve of the injection mechanism is operated to give alternating close and wide spacing of succeeding pockets 14, and the initial cutting of the multiple length rod from the continuously produced product is such that, in the filter cigarette product made as described above, the additive pocket of the individual filter is displaced towards the buccal end. Preferred is option (c), where the continuously produced rod has the same pocket pattern as for (b), but the initial cutting to give the multiple length rod is such that the eventual individual filter has the particulate additive pocket 14 displaced towards the tobacco end and remote from the buccal end; this reduces or eliminates risk of carbon marring the appearance or taste of the filter cigarette. Preferred filter rods of the invention, as illustrated, have the filter material matrix free of stray injected particles, and the matrix and additive pockets substantially free of dust and additive fines. The representation of the additive pockets in FIG. 4 is diagrammatic; in practice each pocket preferably has a more curved surface, being generally ellipsoidal or rugby ball-shaped.

The method and apparatus according to the invention can produce composite additive—carrying filters of conventional size, carbon content and performance. The individual product filters may for example be of conventional circumference (e.g. about 25 mm) and length (e.g. down to 27 or 25 mm long) and have a conventional carbon content of about 15 to 35 mg—or an even higher carbon content of up to 60 mg; for longer tips, higher carbon content is possible. The filters have a filtering performance similar to that for conventional dual filters of the same carbon content. Each particulate additive pocket, in a rod of 25 to 32 mm length, may for example be from 10 to 18 mm long with a diameter of 3 to 4 mm which may reduce somewhat towards each end. The continuous single-pass method and apparatus of the invention can be operated efficiently at commercial speed (e.g. over 200 m per min); transverse, e.g. radial, pneumatic conveyance and injection of the particulate additive maintains separation and maximises accurate location and confinement of the pockets thus reducing or eliminating rejects or variable quality product due to additive dispersal or to pocket coalescence; this is because the transverse pneumatic travel path can be short—for example, in the illustrated device the distance from valve inlet 46 to the point of injection may be only about 135 mm., and even shorter distances are feasible.

The pneumatic injection device employed in the present method and apparatus is advantageous in itself, being compact and efficient and readily fittable to most or all conventional cigarette filter making machines. Thus such fitting to conventional machinery requires at most minor modification or replacement of the gathering funnel to accommodate a lateral injector barrel or conduit, and/or perhaps to provide additional vents for exhaust of pneumatic injection gas; and even such minor modifications may not be needed if the injector barrel is to extend obliquely or axially of and through the open mouth of the gathering device and/or there is provision for lateral extraction of conveyor gas upstream of the particle outlet of the injector barrel and outside of the gathering device. Accordingly, the invention also provides a device for use in injecting particulate additive into a train of tobacco smoke filtering material, the device comprising an injector conduit mountable to extend into (and preferably transversely of) such train and having a valve for discontinuous supply of particulate additive to the conduit, means for repeatedly opening and closing the valve so that particulate additive can enter the conduit when the valve is open, and means for receiving a constant high velocity stream of conveyor gas into the injector conduit to convey said supplied particulate additive along the conduit for discontinuous pneumatic injection into such train. The valve is preferably the same as or similar to that illustrated in FIGS. 2 and 3, as is the means for oscillating it between open and closed positions. The additive supply is preferably from a reservoir for receiving and holding particulate additive under pneumatic pressure, and more preferably the injector conduit extends through the reservoir. The device can have, upstream of the particle outlet of the conduit, means for venting or extracting conveyor gas as described above and for the purposes indicated above.

The invention claimed is:

1. A method of tobacco smoke filter production, said method comprising the steps of:

continuously advancing a train of tobacco smoke filtering material longitudinally;

gathering the advancing filtering material into a rod shape;

shaping and securing the gathered advancing filtering material in rod form; and discontinuously pneumatically injecting particulate additive laterally into the advancing gathering filtering material to form separate additive pockets embedded in and longitudinally spaced along the continuously produced rod form; wherein said step of discontinuously pneumatically injecting includes repeatedly opening and closing a valve to feed particulate additive discontinuously into a pneumatic injector conduit, opening the valve to allow particulate additive to enter the pneumatic injector conduit, and conveying the particulate additive along the pneumatic injector conduit with a stream of compressed gas.

2. The method of claim 1, further including continuously passing particulate additive into a pneumatic injector conduit, and said step of discontinuously pneumatically injecting includes supplying sequential pulses of pressurized gas to the pneumatic injector conduit.

3. The method of claim 1, further including venting gas utilized during said step of discontinuously pneumatically injecting from the advancing gathering filter material.

4. The method of claim 1, further including venting gas utilized during said step of discontinuously pneumatically injecting upstream of a point at which particulate additive is injected into the advancing gathering filtering material.

5. The method of claim 1, wherein said step of continuously advancing includes continuously advancing a train of tobacco smoke filtering material longitudinally along a first direction, and said step of discontinuously pneumatically injecting includes discontinuously pneumatically injecting particulate additive laterally into the advancing filtering material being gathered in a second direction perpendicular to the first direction.

6. The method of claim 1, wherein said step of continuously advancing includes continuously advancing a train of tobacco smoke filtering material longitudinally along a first direction, and said step of discontinuously pneumatically injecting includes discontinuously pneumatically injecting particulate additive laterally into the advancing filtering material being gathered in a second direction which is non-perpendicular to the first direction.

7. The method of claim 1, wherein said step of discontinuously pneumatically injecting includes discontinuously injecting particulate additive into the advancing gathering filtering material utilizing a pressurized gas having a pressure greater than atmospheric pressure.

8. A method of tobacco smoke filter production, said method comprising the steps of:

continuously advancing a train of tobacco smoke filtering material longitudinally;

gathering the advancing filtering material into a rod shape;

shaping and securing the gathered advancing filtering material in rod form; and during said step of gathering, discontinuously pneumatically injecting particulate additive laterally into the advancing filtering material being gathered to form separate additive pockets embedded in and longitudinally spaced along the continuously produced rod form; further including pressurizing a pneumatic injector conduit with a source of pressurized gas, said step of discontinuously pneumatically injecting including repeatedly opening and closing a valve associated with the pneumatic injector conduit so as to supply sequential pulses of pressurized gas to the pneumatic injector conduit, and said step of repeatedly opening and closing including opening the valve and allowing particulate additive to enter the pneumatic injector conduit and conveying the particulate additive along the pneumatic injector conduit and into the advancing filtering material with pressurized gas located within the pneumatic injector conduit, and closing the valve to prevent particulate additive from entering the pneumatic injector conduit.

9. The method of claim 8, further including passing particulate additive into a pneumatic injector conduit, and said step of discontinuously pneumatically injecting includes supplying sequential pulses of pressurized gas having a pressure greater than atmospheric pressure to the pneumatic injector conduit to convey the particulate additive along the pneumatic injector conduit and into the advancing filtering material being gathered.

10. The method of claim 8, wherein said step of discontinuously pneumatically injecting includes supplying sequential pulses of pressurized gas from a pressurized gas source to the pneumatic injector conduit and conveying the particulate additive along the pneumatic injector conduit and into the advancing filtering material being gathered with the pulses of pressurized gas in the pneumatic injector conduit.

11. The method of claim 8, further including pressurizing a pneumatic injector conduit with a source of pressurized gas at a pressure greater than atmospheric pressure, said step of discontinuously pneumatically injecting including repeatedly opening and closing a valve associated with the pneumatic injector conduit so as to supply sequential pulses of pressurized gas to the pneumatic injector conduit, and said step of repeatedly opening and closing including opening the valve and allowing particulate additive to enter the pneumatic injector conduit from a reservoir and conveying the particulate additive along the pneumatic injector conduit and into the advancing filtering material with pressurized gas located within the pneumatic injector conduit, and closing the valve to prevent particulate additive from entering the pneumatic injector conduit from the reservoir.

12. The method of claim 11, further including maintaining the reservoir in a pressurized state with a source of pressurized gas, and receiving and holding particulate additive within the reservoir under pneumatic pressure.

13. The method of claim 8, wherein said step of continuously advancing includes continuously advancing a train of tobacco smoke filtering material longitudinally along a first direction, and said step of discontinuously pneumatically injecting includes discontinuously pneumatically injecting particulate additive laterally into the advancing filtering material being gathered in a second direction perpendicular to the first direction.

14. The method of claim 8, wherein said step of continuously advancing includes continuously advancing a train of tobacco smoke filtering material longitudinally along a first direction, and said step of discontinuously pneumatically injecting includes discontinuously pneumatically injecting particulate additive laterally into the advancing filtering material being gathered in a second direction which is non-perpendicular to the first direction.

15. The method of claim 8, wherein said step of discontinuously pneumatically injecting includes discontinuously pneumatically injecting particulate additive into the advancing gathering filtering material utilizing a pressurized gas having a pressure greater than atmospheric pressure.

* * * * *